US007293600B2

(12) United States Patent
Nierenberg

(10) Patent No.: US 7,293,600 B2
(45) **Date of Patent: *Nov. 13, 2007**

(54) APPARATUS FOR THE REGASIFICATION OF LNG ONBOARD A CARRIER

(75) Inventor: Alan B. Nierenberg, Tampa, FL (US)

(73) Assignee: Excelerate Energy Limited Parnership, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/083,920

(22) Filed: Feb. 27, 2002

(65) Prior Publication Data

US 2003/0159800 A1 Aug. 28, 2003

(51) Int. Cl.
*F28F 1/00* (2006.01)
*F17C 9/02* (2006.01)

(52) U.S. Cl. ..... 165/41; 62/50.2; 62/53.1; 62/53.2; 62/613

(58) Field of Classification Search ..... 165/41; 62/613, 50.1, 50.2, 50.6, 53.1, 53.2; 405/195.1
See application file for complete search history.

(56) References Cited

U.S. PATENT DOCUMENTS

| | | | |
|---|---|---|---|
| 2,795,937 A | | 6/1957 | Sattler et al. |
| 2,938,359 A | | 5/1960 | Cobb, Jr. et al. |
| 2,940,268 A | | 6/1960 | Morrison |
| 2,975,607 A | | 3/1961 | Bodle |
| 3,034,309 A | | 5/1962 | Muck |
| 3,197,972 A | | 8/1965 | King |
| 3,350,876 A | | 11/1967 | Johnson |
| 3,365,898 A | | 1/1968 | Van Kleef |
| 3,438,216 A | | 4/1969 | Smith |
| 3,535,885 A | | 10/1970 | Frijlink et al. |
| 3,561,524 A | | 2/1971 | Satterthwaite et al. |
| 3,724,229 A | | 4/1973 | Seliber |
| 3,755,142 A | | 8/1973 | Whipple, Jr. |
| 3,834,174 A | * | 9/1974 | Strumbos |
| 3,850,001 A | | 11/1974 | Locke |
| 3,897,754 A | | 8/1975 | Jerde |
| 3,975,167 A | * | 8/1976 | Nierman |

(Continued)

FOREIGN PATENT DOCUMENTS

DE 3225299 1/1984

(Continued)

OTHER PUBLICATIONS

California Coastal Commission, "Offshore LNG Terminal Study", Sep. 15, 1978.

(Continued)

*Primary Examiner*—Ljiljana Ciric
(74) *Attorney, Agent, or Firm*—Meyertons, Hood, Kivlin, Kowert & Goetzel, P.C.; Eric B. Meyertons

(57) ABSTRACT

An LNG carrier for transporting LNG from one location to another that includes a vaporizer on board said LNG carrier for vaporizing the LNG to a gaseous state, one or more heat exchangers at least partially submerged in seawater, an intermediate fluid circulating between said vaporizer and said heat exchanger; and one or more pumps for circulating said intermediate fluid is disclosed.

12 Claims, 3 Drawing Sheets

U.S. PATENT DOCUMENTS

| | | | | | |
|---|---|---|---|---|---|
| 3,978,663 | A | | 9/1976 | Mandrin et al. | |
| 3,986,340 | A | * | 10/1976 | Bivins, Jr. | 62/50.2 |
| 4,033,135 | A | | 7/1977 | Mandrin | |
| 4,036,028 | A | | 7/1977 | Mandrin | |
| 4,041,721 | A | | 8/1977 | Kniel | |
| 4,106,424 | A | * | 8/1978 | Schuler et al. | |
| 4,170,115 | A | | 10/1979 | Ooka et al. | |
| 4,219,725 | A | | 8/1980 | Groninger | |
| 4,224,802 | A | | 9/1980 | Ooka et al. | |
| 4,231,226 | A | * | 11/1980 | Griepentrog | 62/50.2 |
| 4,255,646 | A | | 3/1981 | Dragoy et al. | |
| 4,292,062 | A | | 9/1981 | Dinulescu et al. | |
| 4,315,407 | A | | 2/1982 | Creed et al. | |
| 4,329,842 | A | | 5/1982 | Hoskinson | |
| 4,331,129 | A | | 5/1982 | Hong et al. | |
| 4,338,993 | A | | 7/1982 | Fernstrum | |
| 4,417,878 | A | | 11/1983 | Koren | |
| 4,429,536 | A | | 2/1984 | Nozawa | |
| 4,693,304 | A | | 9/1987 | Volland | |
| 4,716,737 | A | | 1/1988 | Mandrin | |
| 4,819,454 | A | | 4/1989 | Brigham et al. | |
| 4,881,495 | A | | 11/1989 | Tornare et al. | |
| 4,924,822 | A | | 5/1990 | Asai et al. | |
| 5,375,580 | A | | 12/1994 | Stolz et al. | |
| 5,400,588 | A | | 3/1995 | Yamane et al. | |
| 5,457,951 | A | | 10/1995 | Johnson et al. | |
| 5,564,957 | A | | 10/1996 | Breivik et al. | |
| 5,711,270 | A | | 1/1998 | Pedersen | |
| 5,762,119 | A | | 6/1998 | Platz et al. | |
| 6,003,603 | A | | 12/1999 | Breivik et al. | |
| 6,079,222 | A | | 6/2000 | Fetescu et al. | |
| 6,089,022 | A | | 7/2000 | Zednik et al. | |
| 6,116,031 | A | | 9/2000 | Minta et al. | |
| 6,164,247 | A | | 12/2000 | Iwasaki et al. | |
| 6,250,244 | B1 | * | 6/2001 | Dubar et al. | 62/613 X |
| 6,298,671 | B1 | | 10/2001 | Kennelley et al. | |
| 6,336,316 | B1 | | 1/2002 | Fujii et al. | |
| 6,367,258 | B1 | | 4/2002 | Wen et al. | |
| 6,367,429 | B2 | * | 4/2002 | Iwasaki et al. | 62/50.2 |
| 6,374,591 | B1 | | 4/2002 | Johnson et al. | |
| 6,546,739 | B2 | * | 4/2003 | Frimm et al. | 62/50.2 |
| 6,598,408 | B1 | * | 7/2003 | Nierenberg | 62/50.2 |
| 6,688,114 | B2 | * | 2/2004 | Nierenberg | 62/50.2 |
| 6,816,669 | B2 | | 11/2004 | Zimmer et al. | |
| 6,832,875 | B2 | * | 12/2004 | Bliault et al. | 405/195.1 |
| 2001/0008126 | A1 | | 7/2001 | Iwasaki et al. | |
| 2002/0073619 | A1 | * | 6/2002 | Perkins et al. | 48/190 |
| 2003/0182948 | A1 | * | 10/2003 | Nierenberg | 62/50.2 |
| 2005/0061002 | A1 | * | 3/2005 | Nierenberg | 60/670 |

FOREIGN PATENT DOCUMENTS

| | | |
|---|---|---|
| EP | 048316 | 5/1981 |
| JP | 52010910 | 1/1977 |
| JP | 52010911 | 1/1977 |
| JP | 53115666 | 10/1978 |
| JP | 53126003 | 11/1978 |
| JP | 54022404 | 2/1979 |
| JP | 54136413 | 10/1979 |
| JP | 54136414 | 10/1979 |
| JP | 56015801 | 2/1981 |
| JP | 56074190 | 6/1981 |
| JP | 58005598 | 1/1983 |
| JP | 59166799 | 9/1984 |
| JP | 61038300 | 2/1986 |
| JP | 62141398 | 6/1987 |
| JP | 1069898 | 3/1989 |
| JP | 05332499 | 12/1993 |
| JP | 09014869 | 1/1997 |
| JP | 11125397 | 5/1999 |
| JP | 11148599 | 6/1999 |
| JP | 2001263592 | 9/2001 |
| WO | WO99/47869 | 9/1999 |
| WO | WO 01/03793 | 1/2001 |

OTHER PUBLICATIONS

Calfornia Coastal Commssion, "Final Report Evaluating and Ranking LNG Terminal Sites", May 24, 1978.

Zednik, J.J., "Shipboard Regasification Terminal", Hydrocarbon Engineering, Oct. 1998.

International Search Report for PCT Application No. PCT/US02/05923, mailed Jun. 7, 2002, 1 page.

SR02 International Search Report for PCT Application No. PCT/US02/09902, mailed Sep. 2, 2002 1 page.

SR03 International Search Report for PCT Application No. PCT/US02/09901, mailed Sep. 12, 2002 1 page.

SR04 International Search International Search Report for PCT Application No. PCT/US04/26293, mailed Jan. 25, 2006 1 page.

SR05 European Patent Office Search Report for EP Application No. 02707906.0, Mar. 21, 2006, 3 pages.

SR06 European Patent Office Search Report for EP Application No. 02715238.8, Mar. 21, 2006, 3 pages.

OA03 Canadian Office of Intellectual Property Communication, Jan. 20, 2006, 2 pages.

OA04 People Republic of China "Notice of First Office Action", Mar. 3, 2006, 9 pages.

OA05 People Republic of China "Notice of First Office Action", Feb. 17, 2006, 9 pages.

USPTO "Office Communication" for U.S. Appl. No. 10/916,625 mailed Oct. 20, 2006, 6 pages, available in PAIR.

Boylston, "Concept Proposal For the Transportation and Regasification of Liquid Natural Gas", 1996, 13 pages.

* cited by examiner 23
24
LNG
NG
PUMP
25
VAPORIZER
22
SUBMERGED HEAT
EXCHANGER(S)
21

Steam
31

26
STEAM HEATER
43
41
51
42
32
Condensate
23
LNG
NG
VAPORIZER
22
46
52
45
44
61
62
SEAWATER OUTLET
SEAWATER INLET
21
SUBMERGED HEAT EXCHANGER(S)

APPARATUS FOR THE REGASIFICATION OF LNG ONBOARD A CARRIER

FIELD OF THE INVENTION

The invention relates to the transportation and regasification of liquefied natural gas (LNG).

BACKGROUND OF THE INVENTION

Natural gas typically is transported from the location where it is produced to the location where it is consumed by a pipeline. However, large quantities of natural gas may be produced in a country in which production by far exceeds demand. Without an effective way to transport the natural gas to a location where there is a commercial demand, the gas may be burned as it is produced, which is wasteful.

Liquefaction of the natural gas facilitates storage and transportation of the natural gas. Liquefied natural gas ("LNG") takes up only about 1/600 of the volume that the same amount of natural gas does in its gaseous state. LNG is produced by cooling natural gas below its boiling point (−259° F. at ambient pressures). LNG may be stored in cryogenic containers either at or slightly above atmospheric pressure. By raising the temperature of the LNG, it may be converted back to its gaseous form.

The growing demand for natural gas has stimulated the transportation of LNG by special tanker ships. Natural gas produced in remote locations, such as Algeria, Borneo, or Indonesia, may be liquefied and shipped overseas in this manner to Europe, Japan, or the United States. Typically, the natural gas is gathered through one or more pipelines to a land-based liquefaction facility. The LNG is then loaded onto a tanker equipped with cryogenic compartments (such a tanker may be referred to as an LNG carrier or "LNGC") by pumping it through a relatively short pipeline. After the LNGC reaches the destination port, the LNG is offloaded by cryogenic pump to a land-based regasification facility, where it may be stored in a liquid state or regasified. To regasify the LNG, the temperature is raised until it exceeds the LNG boiling point, causing the LNG to return to a gaseous state. The resulting natural gas then may be distributed through a pipeline system to various locations where it is consumed.

For safety, ecological, and/or aesthetic considerations, it has been proposed that regasification of the LNG take place offshore. A regasification facility may be constructed on a fixed platform located offshore, or on a floating barge or other vessel that is moored offshore. The LNGC may be either docked or moored next to the offshore regasification platform or vessel, so that LNG may then be offloaded by conventional means for either storage or regasification. After regasification, the natural gas may be transferred to an onshore pipeline distribution system.

It also has been proposed that regasification take place onboard the LNGC. This has certain advantages, in that the regasification facility travels with the LNGC. This can make it easier to accommodate natural gas demands that are more seasonal or otherwise vary from location to location. Because the regasification facility travels with the LNGC, it is not necessary to provide a separate LNG storage and regasification facility, either onshore or offshore, at each location at which LNG may be delivered. Instead, the LNGC fitted with regasification facilities may be moored offshore and connected to a pipeline distribution system through a connection located on an offshore buoy or platform.

When the regasification facility is located onboard the LNGC, the source of the heat used to regasify the LNG may be transferred by use of an intermediate fluid that has been heated by a boiler located on the LNGC. The heated fluid may then be passed through a heat exchanger that is in contact with the LNG.

It also has been proposed that the heat source be seawater in the vicinity of the LNGC. As the temperature of the seawater is higher than the boiling point of the LNG and the minimum pipeline distribution temperature, it may be pumped through a heat exchanger to warm and regasify the LNG. However, as the LNG is warmed, regasified, and superheated, the seawater is chilled as a result of the heat transfer between the two fluids. Care must be taken to avoid cooling the seawater below its freezing point. This requires that the flow rates of the LNG being warmed and the seawater being used to warm the LNG be carefully controlled. Proper balancing of the flow rates is affected by the ambient temperature of the seawater as well as the desired rate of gasification of the LNG. Ambient temperature of the seawater can be affected by the location where the LNGC is to be moored, the time of year when delivery occurs, the depth of the water, and even the manner in which the chilled seawater from warming the LNG is discharged. Moreover, the manner in which the chilled seawater is discharged may be affected by environmental considerations, e.g., trying to avoid an undesirable environmental impact such as ambient water temperature depression in the vicinity of the chilled seawater discharge. Environmental concerns can affect the rate at which the LNG may be heated, and, therefore, the volume of LNG that can be gasified in a given period of time with regasification equipment on board the LNGC.

SUMMARY OF INVENTION

In one aspect, the present invention relates to an LNGC having a regasification system that includes one or more submerged heat exchangers, an on-board vaporizer for vaporizing the LNG, and an intermediate fluid that circulates through the vaporizer and the submerged heat exchanger.

In another aspect, the invention relates to a regasification system for an LNGC, including an on-board vaporizer for vaporizing the LNG and a submerged heat exchanger that is connected to the LNGC after the LNGC reaches the offloading terminal.

DETAILED DESCRIPTION

Various improvements can be made to the manner in which LNG is regasified aboard an LNGC. Specifically, there are other sources of heat, components for heat transfer, and combinations of heat sources, that can be used to provide additional flexibility with respect to the locations and the environmental impact of the onboard LNGC regasification.

Figure 1:
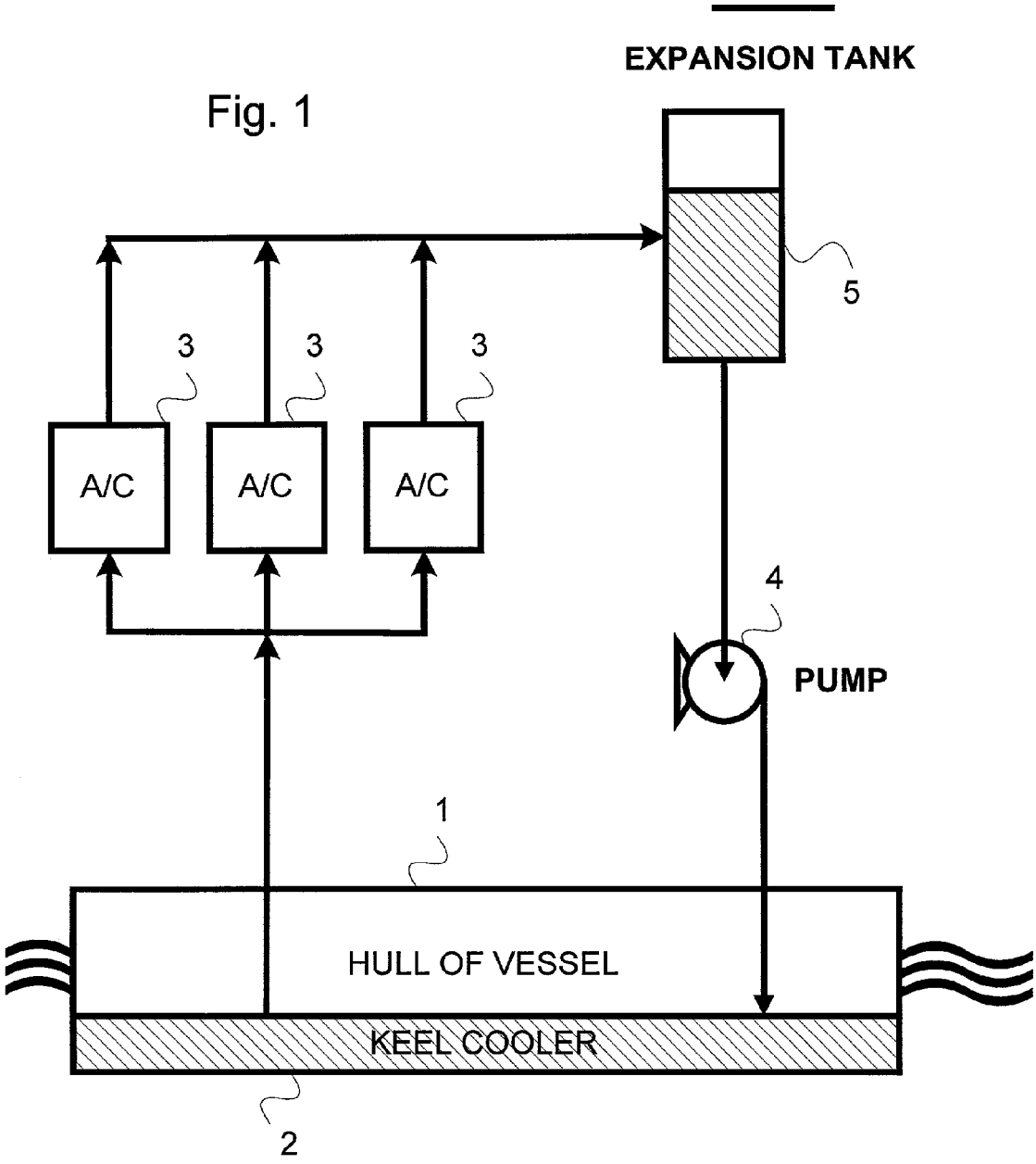
FIG. 1 is a schematic of a prior art keel cooler system.

Devices commonly referred to as "keel coolers" have been used in the past to provide a source of cooling for marine equipment, such as propulsion engine coolers and air conditioning. As shown in FIG. 1, the keel cooler 2 is a submerged heat exchanger that typically is located on or near the bottom of the ship's hull 1, and uses ocean water as a "heat sink" for the heat generated by onboard equipment (such as marine air conditioning units 3) that requires cooling capacity.

The keel cooler 2 operates by either using one or more pods (not shown) that are either built into the lower part of the hull 1 or attached to the exterior of the hull 1 as a heat exchanger that cools an intermediate fluid (such as fresh water or a glycol) that is circulated by pump 1 through the pod. This intermediate fluid is then pumped to one or more locations on the ship to absorb excess heat.

Among the advantages of such a system, as compared to a system that brings in and subsequently discharges seawater to use as a cooling fluid, is the reduced sinking hazard and corrosion hazard that is associated with the circulation of the seawater to various locations onboard the ship. Only the exterior of the keel cooler pod 2 is exposed to the seawater, fresh water, or another relatively non-corrosive fluid that is circulated through the remainder of what amounts to a closed system. Pumps, piping, valves, and other components in the closed loop system do not need to be manufactured from more exotic materials that would be resistant to sea water corrosion. Keel coolers 2 also obviate the need for filtering the seawater, as may be required in a system that passes seawater into the interior of the shipboard machinery components.

Figure 2:
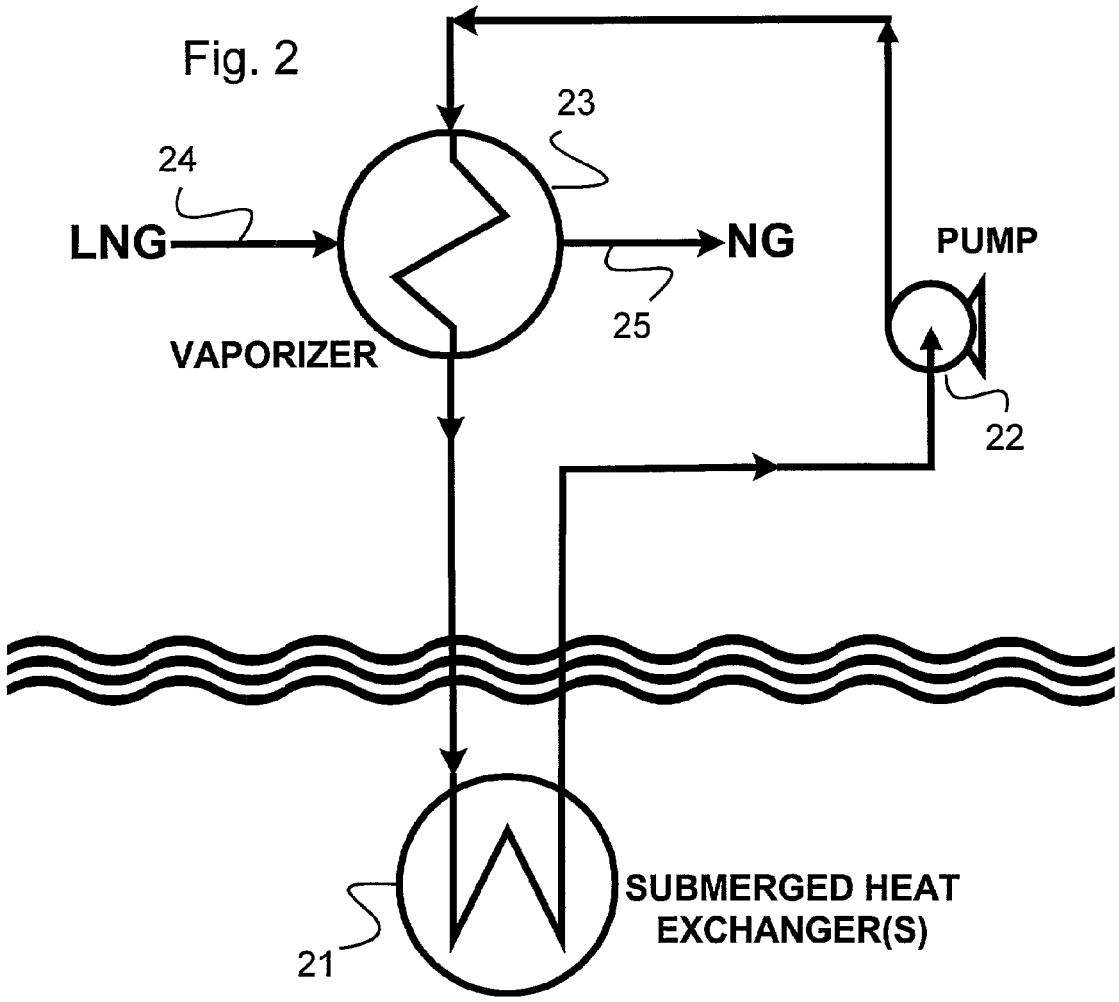
FIG. 2 is a schematic of a submerged heat exchanger used as a source of heat for the vaporizer.

As shown in FIG. 2, in one preferred embodiment of the invention, one or more submerged heat exchangers 21 are employed not to provide cooling capacity, but instead to provide heating capacity for the closed loop circulating fluid, which in turn is used to regasify the LNG.

One or more submerged heat exchanger units 21 may be located at any suitable location below the waterline of the hull 1. They may be mounted directly within the hull 1 of the LNGC, or mounted in one or more separate structures connected to the LNGC by suitable piping. For example, the submerged heat exchanger system may be mounted to the buoy that is used to moor the LNGC. Alternatively, the heat exchangers may be partially, rather than fully, submerged.

An intermediate fluid, such as glycol or fresh water, is circulated by a pump 22 through the vaporizer 23 and the submerged heat exchanger 21. Other intermediate fluids having suitable characteristics, such as acceptable heat capacity and boiling points, also may be used and are commonly known in the industry. LNG is passed into the vaporizer 23 through line 24 where it is regasified and exits through line 25.

The submerged heat exchangers 21 enable heat transfer from the surrounding seawater to the circulated intermediate fluid without the intake or pumping of sea water into the LNGC, as mentioned above. The size and surface area of the heat exchangers 21 may vary widely, depending upon the volume of LNG cargo being regasified for delivery and the temperature ranges of the water in which the LNGC makes delivery of natural gas.

For example, if the temperature of the circulated intermediate fluid is approximately 45° F. upon return to the submerged heat exchanger 21 and the seawater temperature is about 59° F., the temperature differential between the two is about 14° F. This is a relatively modest temperature differential, and, accordingly, the heat exchanger 21 will require a larger surface area to accommodate the heat transfer needs of the present invention, as compared to the typical keel coolers described above, which were designed for the rejection of a few million BTUs per hour. In one preferred embodiment, a submerged heat exchanger 21 designed to absorb approximately 62 million BTUs per hour is used and has approximately 450,000 square feet of surface area. This quantity of surface area may be arranged in a variety of configurations, including, in the preferred embodiment, multiple tube bundles arranged similarly to those in conventional keel coolers. The heat exchanger 21 of the present invention may also be a shell and tube heat exchanger, a bent-tube fixed-tube-sheet exchanger, spiral tube exchanger, falling-film exchanger, plate-type exchanger, or other heat exchangers commonly known by those skilled in the art that meet the temperature, volume and heat absorption requirements for the LNG to be regasified.

In addition, the heat exchanger 21, instead of being mounted in the ship, may be a separate heat exchanger 21 that is lowered into the water after the LNG vessel reaches its offshore discharge facility; or it may be a permanently submerged installation at the offshore discharge facility. Either of these alternative heat exchanger 21 configurations is connected to the LNGC so as to allow the intermediate fluid to be circulated through the submerged heat exchanger 21.

The vaporizer 23 preferrably is a shell and tube vaporizer, and such a vaporizer 23 is schematically depicted in FIG. 2. This type of vaporizer 23 is well known to the industry, and is similar to several dozen water heated shell and tube vaporizers in service at land-based regasification facilities. In alternative shipboard applications, where seawater may be one of the heating mediums or may contact the equipment, the vaporizer 23 is preferably made of a proprietary AL-6XN super stainless steel (ASTM B688) for wetted surfaces in contact with sea water and type 316L stainless steel for all other surfaces of the vaporizer 23. A wide variety of materials may be used for the vaporizer, including but not limited to titanium alloys and compounds.

In the preferred embodiment, a shell and tube vaporizer 23 is used that produces about 100 million standard cubic feet per day ("mmscf/d") of LNG with a molecular weight of about 16.9. For example, when operating the LNGC in seawater with a temperature of about 59° F. and the intermediate fluid temperature is about 45° F., the vaporizer 23 will require a heated water flow of about 2,000 cubic meters per hour. The resulting heat transfer of approximately 62 million BTUs per hour is preferably achieved using a single tube bundle of about forty foot long tubes, preferably about ¾ inch in diameter. Special design features are incorporated in the vaporizer 23 to assure uniform distribution of LNG in the tubes, to accommodate the differential thermal contraction between the tubes and the shell, to preclude freezing of the heating water medium, and to accommodate the added loads from shipboard accelerations. In the most preferred embodiment, parallel installation of 100 mmscf/d capacity vaporizers 23 are arranged to achieve the total required output capacity for the regasification vessel. Suppliers of these types of vaporizers 23 in the U.S. include Chicago Power and Process, Inc. and Manning and Lewis, Inc.

In the preferred embodiment of the invention, the circulating pumps 22 for the intermediate fluid are conventional single stage centrifugal pumps 22 driven by synchronous speed electrical motors. Single stage centrifugal pumps 22 are frequently used for water/fluid pumping in maritime and industrial applications, and are well known to those skilled in the art. The capacity of the circulating pumps 22 is selected based upon the quantity of vaporizers 23 installed and the degree of redundancy desired.

For example, to accommodate about a 500 million standard cubic feet per day ("mmscf/d") design capacity, a shipboard installation of six vaporizers 23, each with a capacity of about 100 mmscf/d, is made. The required total heating water circulation for this system is about 10,000 cubic meters per hour at the design point, and about 12,000 cubic meters per hour at the peak rating. Taking shipboard space limitations into consideration, three pumps 22, each with a 5,000 cubic meter per hour capacity are used and provide a fully redundant unit at the design point circulation requirements of 10,000 cubic meters per hour. These pumps 22 have a total dynamic head of approximately 30 meters, and the power requirement for each pump 22 is approximately 950 kW (kilowatts). The suction and discharge piping for each pump 22 is preferably 650 mm diameter piping, but pipe of other dimensions may be used.

The materials used for the pumps 22 and associated piping preferrably can withstand the corrosive effects of seawater, and a variety of materials are available. In the preferred embodiment, the pump casings are made of nickel aluminum bronze alloy and the impellers have Monel pump shafts. Monel is a highly corrosive resistant nickel based alloy containing approximately 60-70% nickel, 22-35% copper, and small quantities of iron, manganese, silicon and carbon.

While the preferred embodiment of the invention is drawn to a single stage centrifugal pump 22, a number of types of pumps 22 that meet the required flow rates may be used and are available from pump suppliers. In alternative embodiments, the pumps 22 may be smooth flow and pulsating flow pumps, velocity-head or positive-displacement pumps, screw pumps, rotary pumps, vane pumps, gear pumps, radial-plunger pumps, swash-plate pumps, plunger pumps and piston pumps, or other pumps that meet the flow rate requirements of the intermediate fluid.

Figure 3:
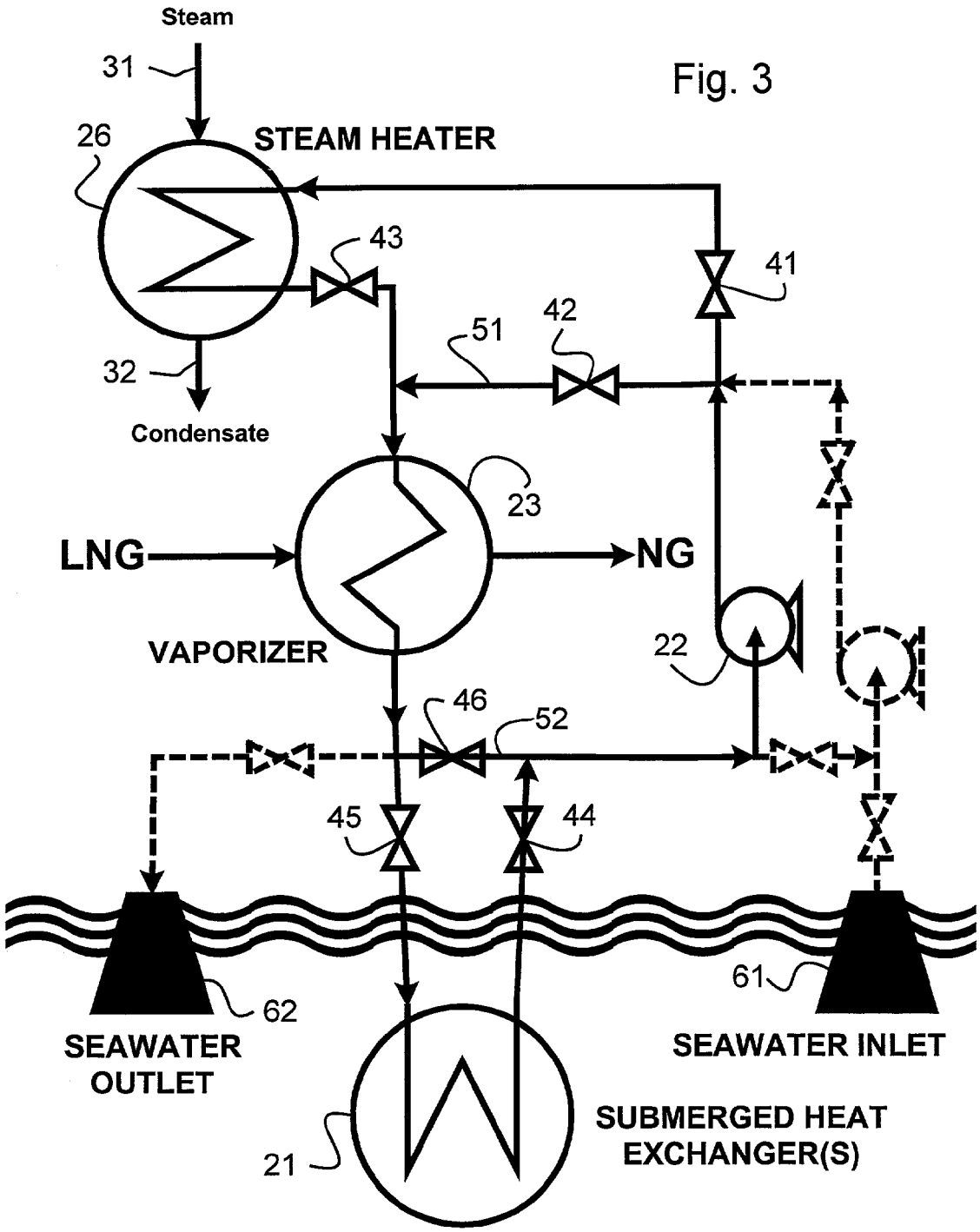
FIG. 3 is a schematic of an alternative dual heat source system.

A submerged or partially submerged heat exchanger system 21 may be used as either the only source of heat for regasification of the LNG, or, in an alternative embodiment of the invention as shown in FIG. 3, may be used in conjunction with one or more secondary sources of heat. In the event that the capacity of the submerged or partially submerged heat exchanger system 21, or the local sea water temperature, are not sufficient to provide the amount of heat required for the desired level of regasification operations, this embodiment of the invention provides operational advantages.

In one preferred alternative embodiment, the intermediate fluid is circulated by pump 22 through steam heater 26, vaporizer 23, and one or more submerged or partially submerged heat exchangers 21. In the most preferred embodiment of the invention, the heat exchanger 21 is submerged. Steam from a boiler or other source enters the steam heater 26 through line 31 and exits as condensate through line 32. Valves 41, 42, and 43 permit the isolation of steam heater 26 and the opening of bypass line 51, which allows the operation of the vaporizer 23 with the steam heater 26 removed from the circuit. Alternatively, valves 44, 45, and 46 permit the isolation of the submerged heat exchanger 21 and the opening of bypass line 52, which allows operation of the vaporizer 23 with the submerged heat exchanger 21 removed from the circuit.

The steam heater 26 preferrably is a conventional shell and tube heat exchanger fitted with a drain cooler to enable the heating of the circulated water, and may provide either all or a portion of the heat required for the LNG regasification. The steam heater 26 is preferrably provided with desuperheated steam at approximately 10 bars of pressure and about 450° F. temperature. The steam is condensed and sub-cooled in the steam heater 26 and drain cooler and returned to the vessel's steam plant at approximately 160° F.

In another alternative embodiment, the heating water medium in the steam heater 26 and drain cooler is sea water. A 90-10 copper nickel alloy is preferrably used for all wetted surfaces in contact with the heating water medium. Shell side components in contact with steam and condensate are preferrably carbon steel.

For the shipboard installation described above, three steam heaters 26 with drain coolers are used, each preferably providing 50% of the overall required capacity. Each steam heater 26 with a drain cooler has the capacity for a heating water flow of about 5,000 cubic meters per hour and a steam flow of about 30,000 kilograms per hour. Suitable steam heat exchangers 26 are similar to steam surface condensers used in many shipboard, industrial and utility applications, and are available from heat exchanger manufacturers worldwide.

The addition of a seawater inlet 61 and a seawater outlet 62 for a flow through seawater system, permit seawater to be used as either a direct source of heat for the vaporizer 23 or as an additional source of heat to be used in conjunction with the steam heater 26, instead of the submerged heat exchangers 21. This is shown in FIG. 3 by the dashed lines.

Alternatively, the submerged or partially submerged heat exchanger system 21 may be used as the secondary source of heat, while another source of heat is used as the primary source of heat for regasification operations. Examples of another such source of heat would include steam from a boiler, or a flow-through seawater system in which seawater is introduced as a source of heat from the ocean (or other body of water in which the LNGC is located) and discharged back into the ocean after being used to heat either the LNG or an intermediate fluid that subsequently is used to heat the LNG. Other sources of heat could include a submerged combustion vaporizer or solar energy. Having a secondary or alternative source of heat in addition to the primary source of heat, whether or not either of the sources is a submerged heat exchanger system, also is considered advantageous.

The use of a primary source of heat coupled with the availability of at least one secondary source of heat provides additional flexibility in the manner in which the LNG may be heated for regasification purposes. The primary source of heat may be used without requiring that source of heat to be scaled up to accommodate all ambient circumstances under which the regasification may take place. Instead, the secondary source of heat may be used only in those circumstances in which an additional source of heat is required.

The availability of a secondary source of heat that is based on an entirely different principal than the primary source of heat also guarantees the availability of at least some heat energy in the event of a failure of the primary heat source. While the regasification capacity may be substantially reduced in the event of a failure of the primary source of heat, the secondary source of heat would provide at least a partial regasification capability that could be used while the primary source of heat is either repaired or the reason for the failure otherwise corrected.

In one embodiment of such a system, the primary source of heat may be steam from a boiler, and the secondary source a submerged heat exchanger system. Alternatively, the primary source of heat may be steam from a boiler, and the secondary source may be the use of an open, flow-through seawater system. Other combinations of sources of heat also may be used depending on availability, economics, or other considerations. Other potential heat sources include the use of hot water heating boilers, intermediate fluid heat exchangers, or submerged combustion heat exchangers, each of which are commercially available products.

In another embodiment of the system, the LNGC may be equipped with a primary heat source, and made ready for the addition of a secondary heat source by including piping and other items that otherwise could require substantial modification of the ship to accommodate. For example, the LNGC could be equipped to use steam from a boiler as the primary source of heat, but also be equipped with suitable piping and locations for pumps or other equipment to facilitate the later installation of a submerged heat exchanger system or a flow-through seawater system without requiring major structural modification of the ship itself. While this may increase the initial expense of constructing the LNGC or reduce the capacity of the LNGC slightly, it would be economically preferable to undergoing a major structural modification of the ship at a later date.

The preferred method of this invention is an improved process for regasifying LNG while onboard an LNG carrier. The LNGC, fitted with regasification facilities as described above, may be moored offshore and connected to a pipeline distribution system through a connection located on an offshore buoy or platform, for example. Once this connection is made, an intermediate fluid, such as glycol or fresh water, is circulated by pump 22 through the submerged or partially submerged heat exchanger 21 and the vaporizer 23. Other intermediate fluids having suitable characteristics, such as acceptable heat capacity and boiling points also may be used as described above. The heat exchanger 21 is preferably submerged and enables heat transfer from the surrounding seawater to the circulated intermediate fluid due to the temperature differential between the two. The intermediate fluid, thereafter circulates to the vaporizer 23, which preferably is a shell and tube vaporizer. In the preferred embodiment, the intermediate fluid passes through parallel vaporizers to increase the output capacity of the LNGC. LNG is passed into the vaporizer 23 through line 24, where it is regasified and exits through line 25. From line 25, the LNG passes into a pipeline distribution system attached to the platform or buoy where the LNGC is moored.

In another method of the invention, the intermediate fluid is circulated through submerged heat exchangers 21 that are mounted in one or more structures connected to the LNGC by suitable piping. In yet another alternative method of the invention, the submerged heat exchangers 21 are mounted to the buoy or other offshore structure to which the LNGC is moored, and connected to the ship after docking.

In another preferred method of the invention, one or more secondary sources of heat are provided for regasification of the LNG. In one embodiment, the intermediate fluid is circulated by pump 22 through steam heater 26, vaporizer 23, and one or more submerged or partially submerged heat exchangers 21. Steam from a boiler or other source enters steam heater 26 through line 31 and exits as condensate through line 32. Valves 41, 42 and 43 permit operation of the vaporizer 23 with or without the steam heater 26. In addition, the vaporizer 23 may be operated solely with use of the secondary sources of heat such as the steam heater 26. Valves 44, 45, and 46 permit isolation of these submerged heat exchangers 21, so that the vaporizer 23 may operate without them.

In another method of the invention, a flow through seawater system, with an inlet 61 and an outlet 62, permit seawater to be used as a direct source of heat for the vaporizer 23 or as an additional source of heat to be used in conjunction with the steam heater 26, instead of the submerged heat exchanger 21. Of course, the submerged or partially submerged heat exchanger system 21 may be used as a secondary source of heat, while one of the other described sources of heat is used as the primary source of heat. Examples of this are described above.

Various exemplary embodiments of the invention have been shown and described above. However, the invention is not so limited. Rather, the invention shall be considered limited only by the scope of the appended claims.

What is claimed is:

1. A LNG carrier for transporting LNG from one location to another, comprising:

a vaporizer on board the LNG carrier for vaporizing the LNG to a gaseous state;

one or more heat sources, wherein at least one of the heat sources comprises one or more heat exchangers, wherein at least one of the heat exchangers is moveably fixed onboard the LNG carrier such that the at least one heat exchanger is configured to be lowered into the water for use; and at least one pump for circulating an intermediate fluid between the vaporizer and the at least one heat exchanger;

wherein the at least one heat exchanger is configured to transfer heat to said intermediate fluid.

2. The carrier of claim 1, wherein the at least one heat exchanger is attached to an exterior surface of the LNG carrier.

3. The carrier of claim 1, wherein the at least one heat exchanger is at least partially submerged in water during use.

4. The carrier of claim 1, further comprising mechanical equipment configured to lower the at least one heat exchanger into the water.

5. The carrier of claim 1, wherein the at least one heat exchanger is configured to be submerged and attached to the LNG carrier.

6. The carrier of claim 1, wherein the at least one heat exchanger is configured to be submerged and integral with the LNG carrier hull.

7. The carrier of claim 1, wherein at least one of the heat exchangers is configured to be attached to a buoy.

8. The carrier of claim 1, wherein at least one of the heat exchangers is fully submerged in seawater.

9. The carrier of claim 1, wherein the intermediate fluid comprises a glycol.

10. The carrier of claim 1, wherein the intermediate fluid comprises water.

11. The carrier of claim 1, wherein at least one of the heat exchangers is configured to enable heat transfer from seawater outside the hull of the carrier to the vaporizer.

12. The carrier of claim 1, wherein at least one of the heat sources comprises one or more heaters.

* * * * *